United States Patent [19]

Anderson et al.

[11] 4,091,382

[45] May 23, 1978

[54] DISPLAY SYSTEM

[75] Inventors: Andrew G. Anderson; William D. Greason; Anantaraman R. Prasan, all of London, Canada

[73] Assignee: Willis J. Ball, London, Canada

[21] Appl. No.: 726,747

[22] Filed: Sep. 27, 1976

[51] Int. Cl.[2] ..... G08B 5/00

[52] U.S. Cl. ..... 340/373; 340/378 R

[58] Field of Search ..... 340/373, 378 R, 366 E, 340/366 G, 366 R

[56] References Cited

U.S. PATENT DOCUMENTS

| | | | |
|---|---|---|---|
| 3,460,134 | 8/1969 | Aiken | 340/378 R |
| 3,648,281 | 3/1972 | Dahms | 340/373 R |
| 3,745,563 | 7/1973 | Jones | 340/378 R |

*Primary Examiner*—Harold I. Pitts

[57] ABSTRACT

A display system is made up of an array of blocks, each block in turn consisting of rows and columns of individual display units each having a thin, pivotally mounted vane movable by electrostatic forces between an upright (WRITE) position and a horizontal (ERASE) position. A message can be displayed by selection of a pattern of vanes moved from one position to the other. Each vane assembly is symmetrically bistable, being movable in both directions by the same triggering electrodes which are subjected to a short pulse of high D.C. voltage that kicks the vane towards a mid position and subsequently allows it to continue its travel under its own momentum and gravity. Selection of units not to be operated is carried out by means of inhibit electrodes located near the vane in its extreme positions, such electrodes, when energized, preventing movement by the triggering electrodes. By having two write inhibit electrodes adjacent the vane in its horizontal position and two erase inhibit electrodes adjacent the vane in its upright position, it is possible to energize a pattern of inhibit electrodes that will permit a given triggering signal to move only a single selected vane of the array.

12 Claims, 36 Drawing Figures

DISPLAY SYSTEM

BACKGROUND OF THE INVENTION

FIELD OF THE INVENTION AND DESCRIPTION OF PRIOR ART

This invention relates to improvements in a display system of the type that comprises an array of display units each having a small, thin pivoted vane movable by an electrostatic field between a WRITE and an ERASE position. In the ERASE position the vane lies substantially horizontally and is effectively hidden from view; in the WRITE position it is erect and visible. By selection of a pattern of vanes that are moved from one position to the other the array can be caused to produce a display in the form of a verbal or pictorial message.

Such displays may be black-on-white or white-on-black, or the vanes may be coloured. The display may be illuminated by ambient light and/or artificial light. The light may come from the front or the rear.

Such systems are known, an example thereof being illustrated in U.S. Pat. No. 3,304,549 issued Feb. 14, 1967 to W. R. Aiken (Canadian Pat. No. 776,373 issued Jan. 23, 1968).

SUMMARY OF THE INVENTION

The present invention is concerned with improvements in such a system and in individual display units for use therein.

To this end, in one aspect the invention is concerned with an improved display unit in which the vane is symmetrically bistable, i.e. is such as to remain reliably in either of its extreme positions (WRITE or ERASE) under the force of gravity. This feature avoids the need common in prior systems to continue to apply an electrostatic potential to maintain the condition of the unit, e.g. to continue to maintain the vane erect in its WRITE position. This feature represents an important practical saving, especially when an array of such units is used in a display sign on which a message is to be written and left unchanged for a substantial length of time, sometimes as long as a day at a time or even longer.

Another improvement that is an objective of the present invention is a simplification of the electrode structure used to exert the attracting electrostatic forces on the vane. More specifically, the invention provides a single triggering electrode arrangement (which may consist of two or more interconnected electrodes for symmetry of forces) that moves the vane in both directions. This arrangement avoids the need for two separate electrode systems. In the past it has been usual to employ one electrode or electrode system for moving the vane to its WRITE position and another electrically separate electrode or system for moving it to its ERASE position. In the present invention, the same triggering electrode (or electrode system) moves the vane from WRITE to ERASE and from ERASE to WRITE.

This effect is achieved by applying to such triggering electrode system a short pulse of a high D.C. voltage relative to the vane (e.g. 3000 volts) to attract the vane from whichever position it is occupying towards its mid position. By virtue of its symmetrically bistable nature the centre of gravity of the vane or more accurately the whole vane assembly (the vane itself and its pivotal mount) crosses over the vertical plane through the pivotal axis at this mid position. By making the pulse short (e.g. 40 - 50 milliseconds), the electrostatic attraction will have disappeared by the time the vane has reached this mid position so that it will continue movement beyond the mid position by virtue of its own momentum and eventually, once past the mid position, with the assistance of gravity.

It should be noted that, in speaking of a mid position, this position need not be at exactly the 45° location, assuming a 90° vane movement, although in practice it will probably be quite close thereto. The important consideration is an effective symmetry of operation.

In a preferred construction of an individual unit according to the invention, the unit is also provided with so-called inhibit electrodes that are respectively located near the vane in its extreme positions. Any one of these electrodes, when energised, can act to retain the vane in the position adjacent the electrode and thus prevent it from being moved to its other position by the trigger electrode system.

In a preferred system, a plurality of such units are arranged in a block of rows and columns. In turn, a plurality of such blocks can be arranged in rows and columns to form a large array on which the verbal or pictorial message will appear by virtue of the pattern set up by the positions of the vanes of the individual units. These positions will be controlled by appropriate interconnections for the application of control potentials to the triggering and inhibit electrode systems of the units. Examples of such interconnections are provided below.

BRIEF DESCRIPTION OF THE DRAWINGS

Embodiments of the invention are illustrated by way of example in the accompanying drawings, in which.

DESCRIPTION OF THE PREFERRED EMBODIMENTS

AN INDIVIDUAL DISPLAY UNIT GENERALLY AND ITS OPERATION

FIGS. 1 to 13 illustrate the general structure and function of an individual display unit 10 of which a number, for example sixty-three (in seven columns and nine rows), are formed in a block 9 or module (FIG. 14) in the manner to be further described below.

Figure 33:
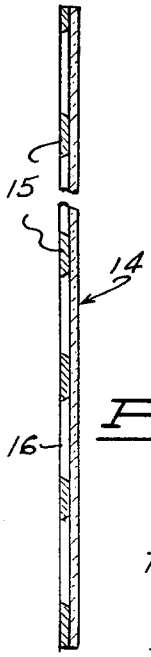
FIG. 33 is a vertical cross-section taken on the line XXXIII—XXXIII in FIG. 32.
Figure 34:
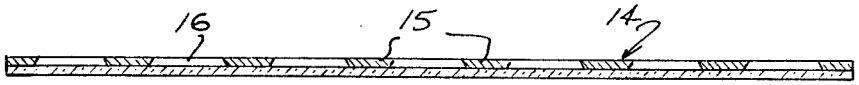
FIG. 34 is a horizontal cross-section taken on the line XXXIV—XXXIV in FIG. 32.

Each unit 10 takes the form of a rectangular enclosure defined between a grid work of vertical members 11 and horizontal members 12. The detailed structure of these members is described separately below. Each enclosure is completed by means of a common back plate 13 and a common front plate 14, the latter having been omitted from FIG. 1 to show the internal parts of the display unit more clearly, although the back and front plates are made of a transparent plastic material, except that the front plate 14 includes a grid work of horizontal and vertical opaque bars 15 (see also FIGS. 32–34) which serve to hide the mounting members 32 and define sixty-three individual windows 16 as best appreciated from FIG. 14. It may also be convenient to make the main vertical and horizontal members 11, 12 of a similar transparent plastic material, although it is not critical for operation whether these members are transparent or not.

It will be noted from FIGS. 1–6 that in each display unit 10 there is a vane assembly 20, details of which are shown in FIGS. 7 to 10. This vane assembly 20 consists of a thin, metallic, planar vane 21 with edges 22 bent at right angles. The outer face 23 of the vane 21 can be painted black, or covered with a thin black foil, or coloured with paint or other covering of any convenient nature that will provide a contrasting appearance when raised to its vertical or WRITE position compared with units in which the vanes remain in their horizontal (ERASE) positions. This contrast is visible in FIG. 14. The coating on the vane should be conducting or semiconducting to eliminate the possibility of static build up on its surface. The display block will normally be illuminated from the rear, i.e. through the transparent back plate 13, so that vane assemblies in their WRITE positions will block the passage of transmitted light. Alternatively, the contrasting effect can be achieved by illuminating the assembly from the front, in which case, of course only the front plate needs to be transparent.

At its base 24, the vane 21 is connected to a mounting member 25 having the shape of a cylinder with about a quarter cut-away. In this cut-away portion 26 there is secured a hinge member 27 which has obliquely cut, projecting ends **27*a* that form knife edges serving to mount the vane in sockets 30 (FIGS. 11–13) formed in upwardly projecting bent portions 31 of mounting members 32 that extend horizontally across the block at a lower edge of each row of display units. The mounting member 25 acts as a weight. By varying slightly the position of the hinge member 27 relative to the mounting member 25 (in the direction shown by the arrow A in FIG. 8**) the position of the centre of gravity G of the assembly relative to the pivotal axis X can be varied, allowing easy adjustment of the mechanical retarding torque $T_M$ of the vane assembly.

Figures 7, 8, 9, 10, 11, 12:
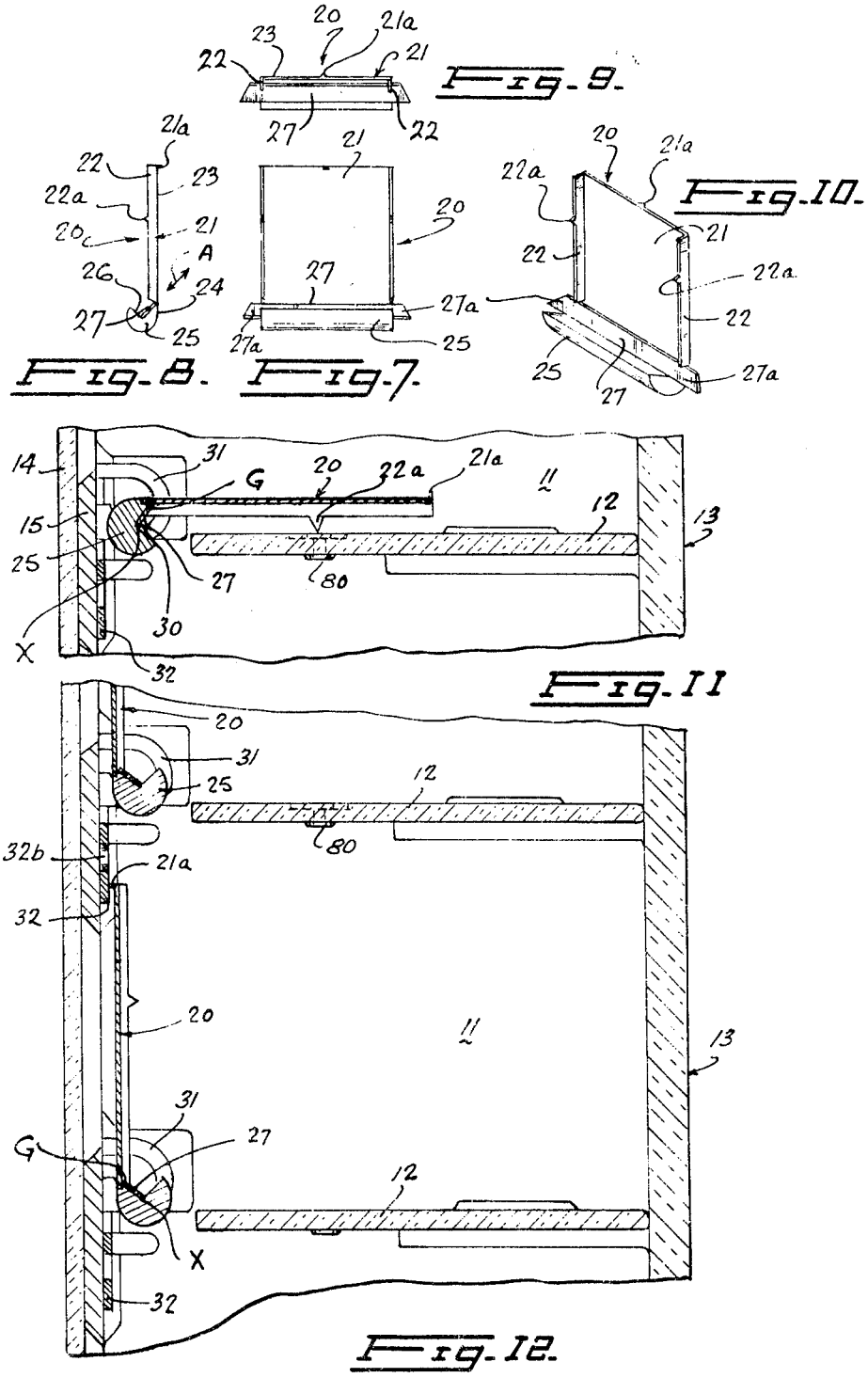
FIG. 7 is a rear view of a vane assembly per se.
FIG. 8 is a view of the vane assembly as seen from the right of FIG. 7.
FIG. 9 is a plan view of FIG. 7.
FIG. 10 is a perspective view of the vane assembly of FIGS. 7-9.
FIG. 11 is a large scale fragment taken on the line XI—XI in FIG. 1 further illustrating the manner of hinging of the vane assembly, with the latter in its lowered position and with some other structure omitted for clarity.
FIG. 12 is similar to FIG. 11, but with the vane assembly in its raised position.
Figure 13:
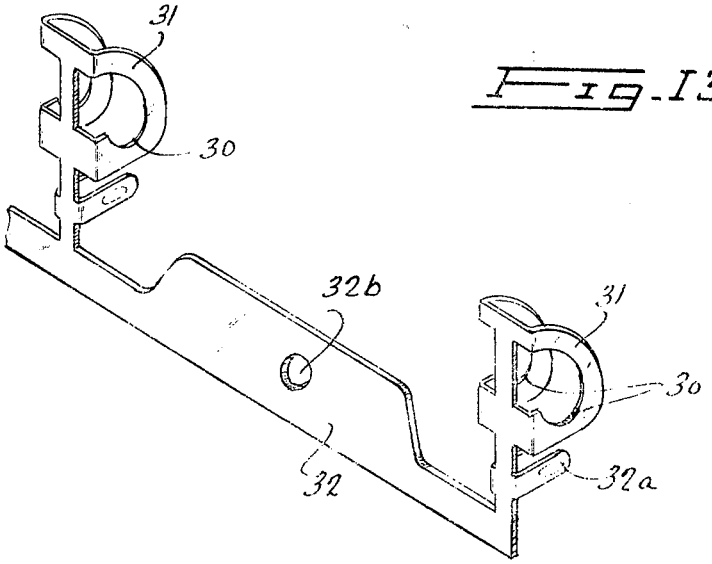
FIG. 13 is a perspective view of one of a number of mounting members that extend horizontally across the block to provide the means for mounting the vane assemblies.

Each vane assembly 20 is movable between its horizontal ERASE position and its vertical WRITE position by electrostatic forces, as more fully explained below. This pivotal movement takes place by virtue of the mounting of the knife edge ends **27*a* in respective sockets 30. FIGS. 11 and 12 demonstrate that the vane assembly 20 is bistable, since in each of its extreme positions the centre of gravity G of the vane assembly 20** is located on that side of the pivotal axis X that will act to retain the vane assembly in such position. The changeover of the centre of gravity G from one side to the other of the vertical plane through the axis X takes place at approximately the mid-position of the pivotal travel, i.e. at an angle of about 45° to the horizontal. On either side of such midposition, the vane assembly will be urged by gravity towards the nearer extreme position.

This symmetrically bistable nature of the vane assembly is an important ingredient of the present invention, because it enables each vane to remain reliably in either its WRITE or its ERASE position without the need to continue to apply any electrostatic forces to maintain such condition.

Figure 1:
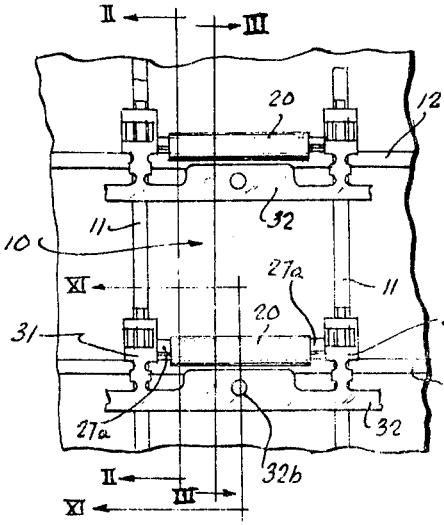
FIG. 1 is a front view, with a front plate removed for clarity, of a portion of a display block showing an individual display unit with its vane assembly in the lowered or ERASE position.
Figure 2:
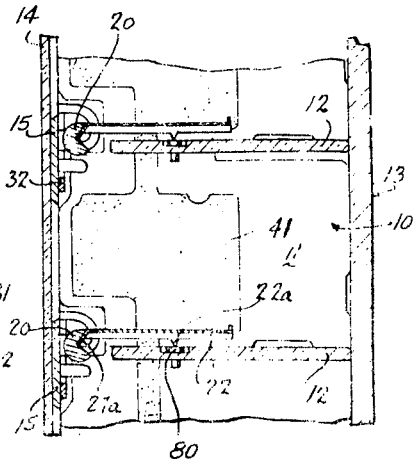
FIG. 2 is a vertical, transverse section taken on the line II—II in FIG. 1, but with the front plate now in place.
Figure 3:
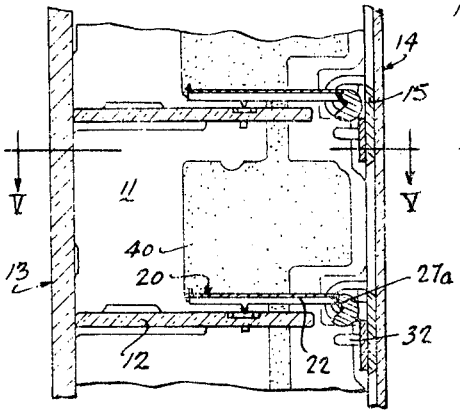
FIG. 3 is a similar section on the line III—III in FIG. 1.
Figure 4:
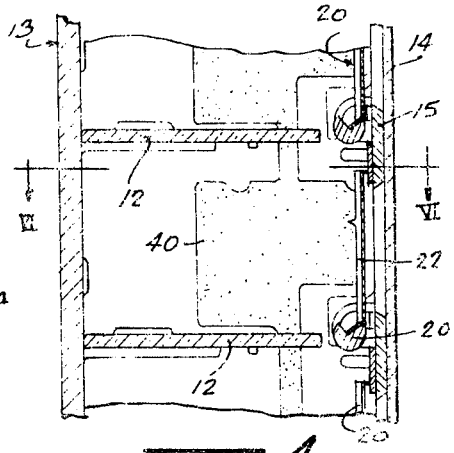
FIG. 4 is a view similar to FIG. 3 but showing the vane assembly in its raised or WRITE position.

Movement of each vane assembly between its WRITE and ERASE positions is produced by attracting electrostatic forces generated by trigger electrode means, which, in the present example, consists of a pair of trigger electrodes 40 and 41 formed as conductive deposits of a suitable metal, e.g. aluminum or silver, on the vertical members 11 as shown in FIGS. 2 to 4. As can be appreciated from these figures as well as from FIGS. 5 and 6 where the thickness of these deposits 40, 41 has been shown by a heavy line to make them visible, these trigger electrodes 40, 41 are located adjacent the side edges 22 of the vane 21. The effect of applying a high D.C. voltage, e.g. 3000 volts, to these electrodes while the vane is grounded is to attract the vane towards its mid-position, since in this mid-position the capacitance between the electrodes and the vane is a maximum. The system will work with the electrodes at a positive or negative voltage with respect to the vane. The forces are the same in both cases, although with the electrodes at a negative potential with respect to the vane, it has been shown experimentally that the system can be operated at higher voltages before the onset of arcing. Hence a negative voltage is usually chosen. If this energisation were maintained, the vane assembly would remain in this mid-position. However, by pulsing the trigger eletrodes for an appropriately short length of time, the effect is to give the vane assembly a kick towards its mid-position, while allowing it to continue its travel past the mid-position under its own momentum no longer impeded by any attraction from the electrodes. Once past the mid-position the vane assembly continues to its other extreme position under gravity as well as by reason of its momentum. The reverse rotation takes place next time the same electrodes are similarly pulsed. Thus by providing an accurately dimensioned pulse, the vane assembly can be moved out of whichever extreme position it happens to occupy and brought to its other extreme position. In other words, pulsing of the same trigger electrode system serves to move the vane either from its WRITE to its ERASE position or from its ERASE to its WRITE position, rendering unnecessary separate triggering electrode systems dependent upon the direction of movement required. The ideal duration of the pulse will depend on the voltage employed and the dimensions of the unit and vane assembly. In a typical installation such duration can be of the order of 40 – 50 milliseconds. Even shorter pulses would theoretically operate the system but are difficult to achieve in practice.

To be more specific in connection with this triggering movement of a vane, it should first be noted from FIGS. 2, 3 and 4 that in both extreme positions there is some overlap between the vane edges 22 and the edges of the trigger electrodes, this being necessary in order to achieve a comparatively strong electrostatic force at the very start of the movement to overcome the inertia and the retarding mechanical moment due to gravity. Experiments have shown best results with a slight vane/electrode overlap.

The electrostatic torque generated by each trigger electrode (assuming the vane in its horizontal position) is given by $$T = \tfrac{1}{2} V^2 (dc/d\theta)$$

where

T = electrostatic force (newton·meters)
V = applied potential difference (volts)
c = capacitance between the electrode and the vane (farads)
$\theta$ = angular displacement from the $x$ axis (radians)
$(dc/d\theta)$ = rate of change of capacitance with respect to angular position away from the $x$ axis reference.

Theoretically, one might expect the capacitance to be a near step function when plotted against angular position. However, fringing of the electric field flux lines makes the curve more "S" shaped in nature. This has been proven experimentally using electric flux line mapping techniques and it was found that, if the edge of the vane is below the bottom surface of the trigger electrode, the resulting slope of the C vs $\theta$ curve is low, which results in a low electrostatic force, whereas with vane/electrode overlap this slope and hence the force was markedly increased. Similar results were observed with movement from the vertical position.

The mechanics of the vane motion are as follows: From basic rotational mechanics, $$T = I\alpha$$

where $T$ - resultant torque (meter·newtons)
$I$ = moment of inertia about the axis of rotation (kgm·m$^2$)
$\alpha$ = angular acceleration (rad/sec$^2$)

In the operation of the vane, $$T = T_E - T_M$$

where $T_E$ = electrostatic torque = $\tfrac{1}{2} V^2 (dc/d\theta)$
$T_M$ = mechanical retarding torque (meter·newtons), i.e.,
$T_M = W.g.l._{\cos(90-\theta')}$ where $W$ = mass of vane (Kgm)
$g$ = acceleration due to gravity
$l$ = distance from the pivot point X to the center of gravity G(meters), and
$\theta'$ = angle that the vane is away from the 45° line These considerations apply equally to movement from either extreme position.

CONSTRUCTION AND ASSEMBLY OF THE VERTICAL AND HORIZONTAL MEMBERS

Figure 19:
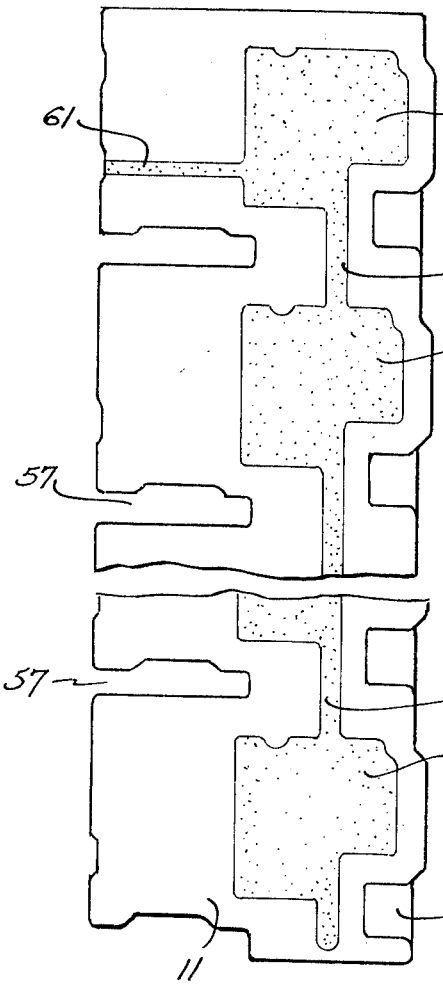
FIG. 19 is a front view of a centrally located vertical member used in the construction of the block of FIG. 14, as seen from the left of FIG. 14.

The triggering electrodes 40, 41 facing each other across each vane assembly are electrically interconnected in a manner described below. In addition, as will be seen from FIGS. 19 and 20, these electrodes 40, 41 are also interconnected column-wise along the elongated, flat vertical members 11 by means of strips 42 of similar deposited conducting material.

Figure 14:
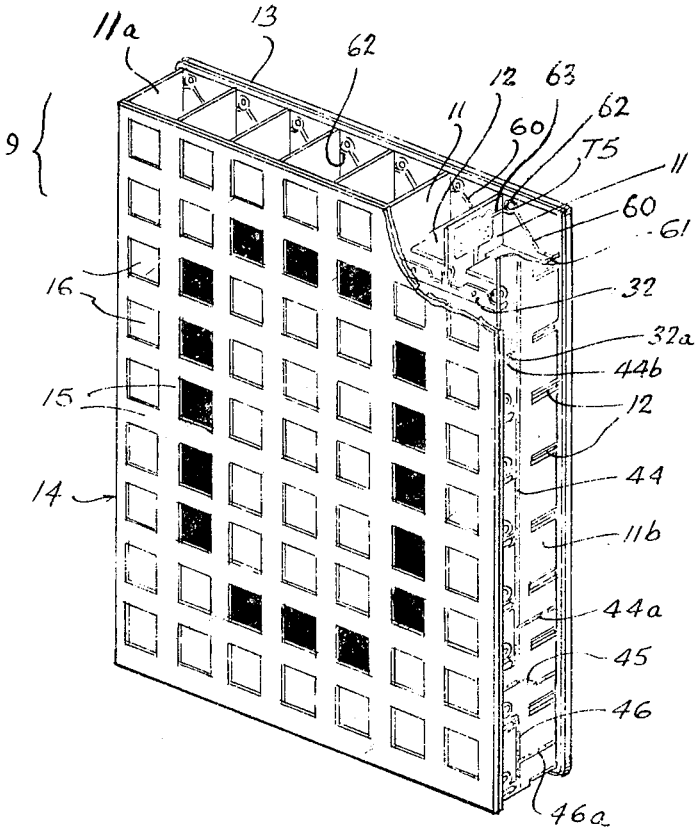
FIG. 14 is a perspective, partly cut away view of a block of display units illustrating the manner in which a number of individual vanes can be moved to their WRITE positions to display a character, in this case the numeral 0.

FIGS. 21 to 24 show a vertical member 11*a* which is a member 11 modified for use on the left hand outer edge of the block 13 shown in FIG. 14, such modified member 11*a* having interconnected trigger electrode surfaces 41 on its inner surface while being uncoated on its outer surface 43.

Figures 25, 26, 27:
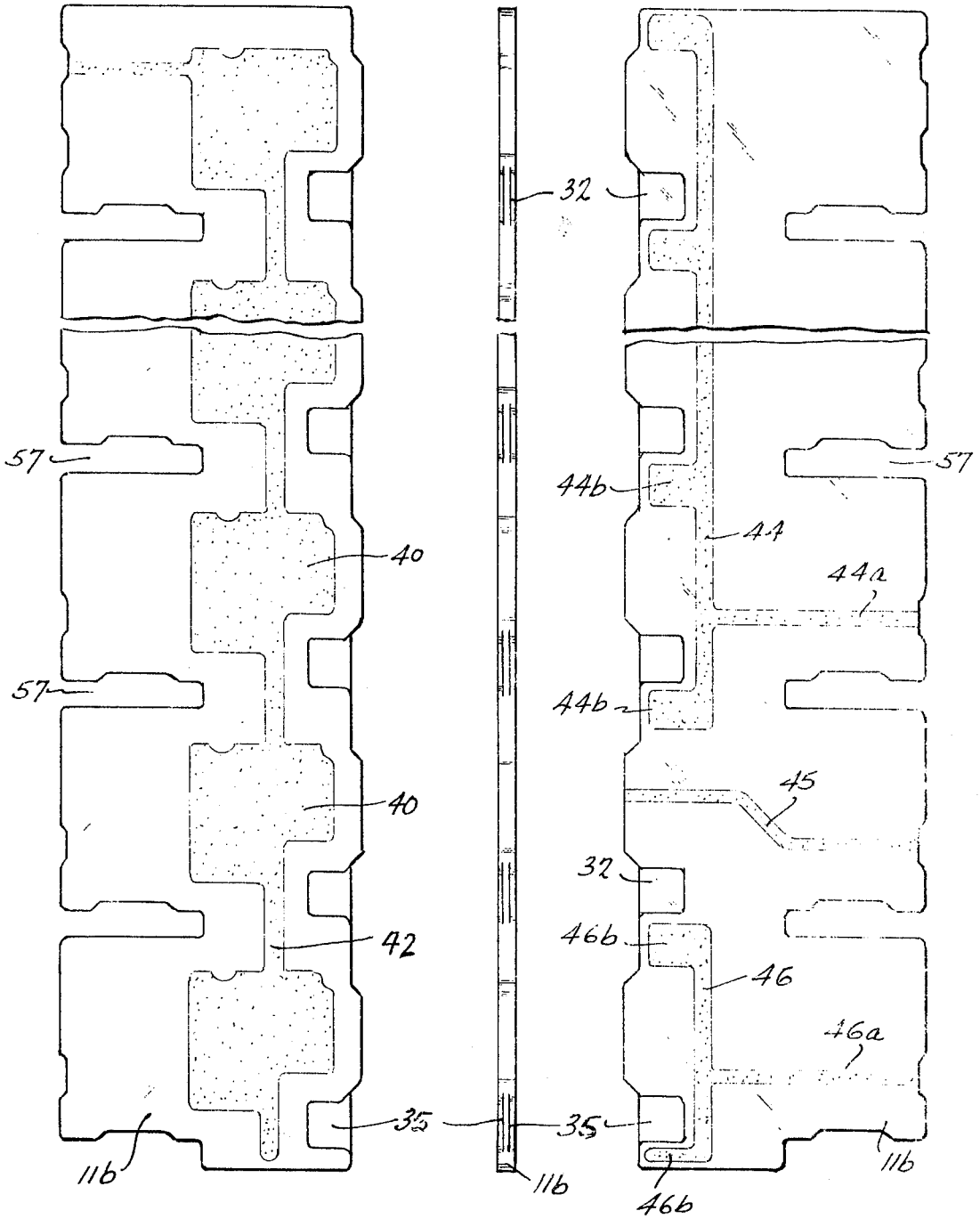
FIG. 25 is a view similar to FIG. 19 of a vertical member modified for use on the right hand, outer side of the block.
FIG. 26 is an edge view of this member as seen from the right hand side of FIG. 25.
FIG. 27 is a rear view of the member of FIG. 25.
Figure 28:
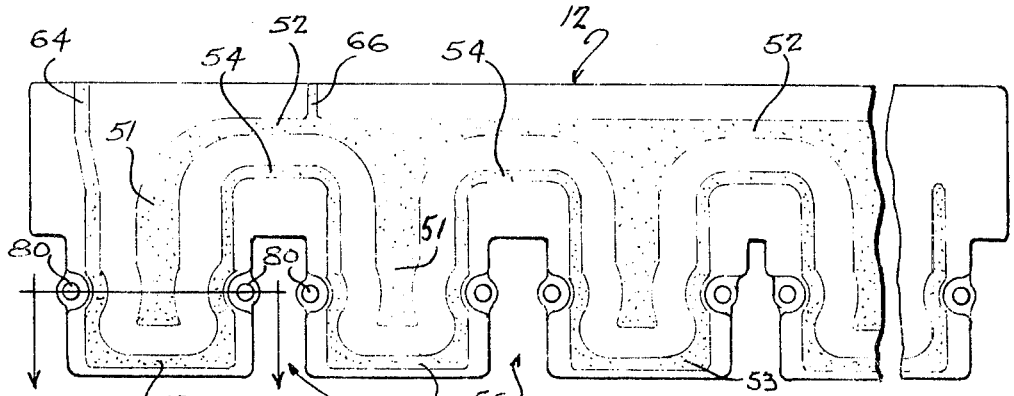
FIG. 28 is a plan view of a horizontal member employed in the construction of the block of FIG. 14.
Figure 29:
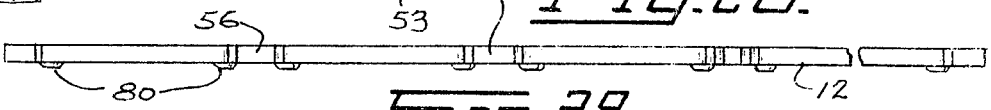
FIG. 29 is an edge view of this member as seen from the lower side of FIG. 28.

FIGS. 25 to 27 show a vertical member 11*b* which has been modified for use as the outer vertical member on the right hand side of the block shown in FIG. 14, such modified member 11*b* having interconnected trigger electrode surfaces 40 on its inner face and deposited strips of electrically conducting material 44, 44*a*, 44*b*, 45, 46, 46*a* and 46*b* on its outer face, the function of these strips to be described below.

Figure 5:
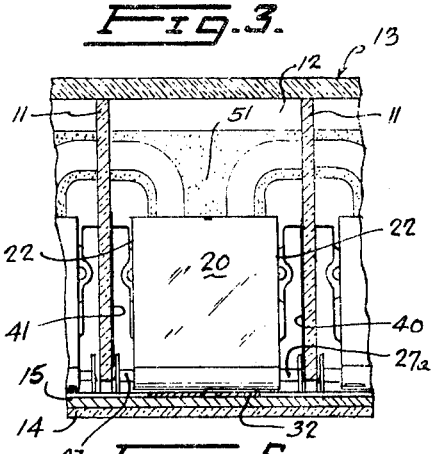
FIG. 5 is a horizontal, transverse section taken on V—V in FIG. 3, i.e. with the vane assembly in its lowered position.

It is first appropriate to describe the nature of each elongated, flat horizontal member 12 as shown in FIGS. 28 to 31. The top surface of each member 12 is coated with electrically conducting material forming a first series of electrodes 51, each underlying a respective vane 21 when it is in its lowered position (FIG. 5). The electrodes 51 are interconnected by strips 52 along the entire row of seven units. A second series of electrodes 53 is formed by electrically conducting material on the surface of the horizontal member 12, these electrodes 53 similarly underlying each respective vane in its lowered position and being interconnected by strips 54. Like the electrodes 51, the electrodes 53 are electrically common for an entire row of seven units in the block.

Figure 30:
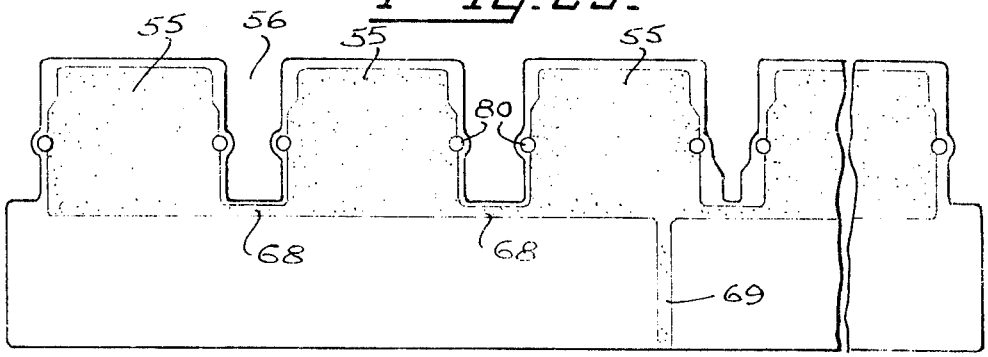
FIG. 30 is an underside view of the member of FIG. 28.
Figure 31:
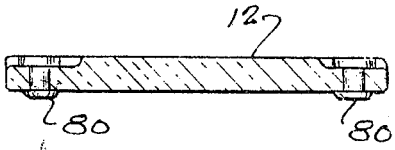
FIG. 31 is a section on the line XXXI—XXXI in FIG. 28.

On its under-side as seen in FIG. 30, the horizontal member 12 is formed with a series of electrically conducting surfaces 55 joined by strips 68, these surfaces being grounded and thus serving to shield the individual units from one another in the vertical direction.

It will also be noted that the horizontal members 12 are formed with slots or cut-outs 56. When the block 9 is assembled these cut-outs 56, which face towards the front, engage rearwardly facing cut-outs 57 of the vertical members 11, 11*a* and 11*b*. An assembly is made of a spaced series of six parallel vertical members 11 and one each of the side members 11*a* and 11*b* interleaved with a spaced series of nine parallel horizontal members 12. These members are then joined together by suitable means, conveniently by ultrasonic welding of the plastic material. The result is a rigid honeycomb structure of vertical and horizontal members, each intersection forming a corner of respective adjacent display units. The assembly as a whole provides a block of 63 enclosures forming display units arranged in nine rows and seven columns. FIG. 14 shows the top row of display units open at the top. In practice these units are closed by an outer casing (not shown) of transparent plastic material that encloses the whole block 9 and is welded in a groove 13*a* (FIG. 18) encircling the plate 13, thus providing a sealed modular construction.

Figure 24:
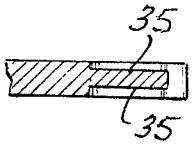
FIG. 24 is a fragmentary section on the line XXIV—XXIV in FIG. 21.

The mounting members 32 for the vane assemblies are disposed along the front of the assembly of horizontal and vertical members, the bent portions 31 of the members 32 being in register with depressions 35 formed in the vertical members 11, 11*a* and 11*b* (see detail in FIG. 24). These depressions 35 serve another important purpose. They allow the length of the vane axle (27, 27*a*) to be made sufficiently great to insure that the vane will not escape from the mount, while, at the same time, insuring that the ends of the axle will not bind with the walls of the vertical members. The socket 30 has been designed to allow easy insertion of the vane assembly from the front; yet when the front plate 14 is secured flush with the front surface of the mounting member 32, the front of the opening is closed, guaranteeing that the vane assembly cannot escape.

The number of display units chosen to form a block is arbitrary. An array of seven by nine is convenient for writing most characters, such as letters and numbers, but any other convenient numbers can be chosen.

BACK PLATE AND ELECTRODE INTERCONNECTION

Figure 15:
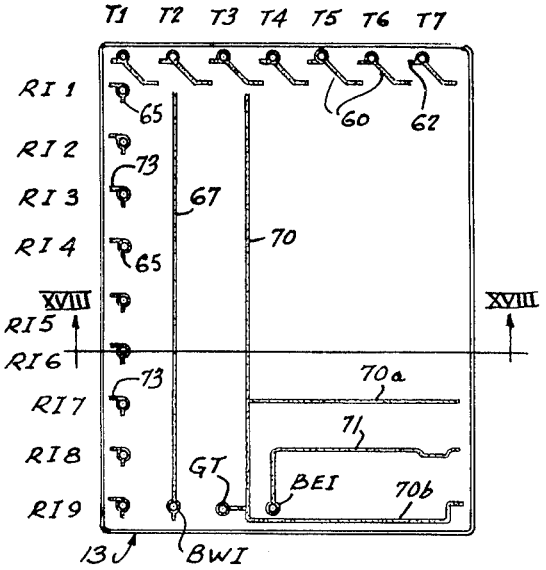
FIG. 15 is a front view of the back plate of the block of FIG. 14, i.e. as seen from inside the block.
Figure 16:
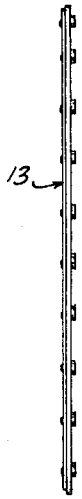
FIG. 16 is an edge view of the back plate of FIG. 15 seen from the right hand side of FIG. 15.
Figure 17:
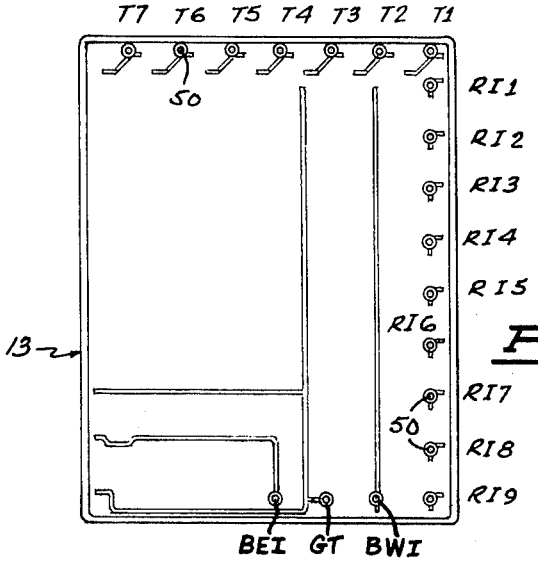
FIG. 17 is a rear view of the back plate of FIG. 15, i.e. as seen from the exterior of the block.
Figure 20:
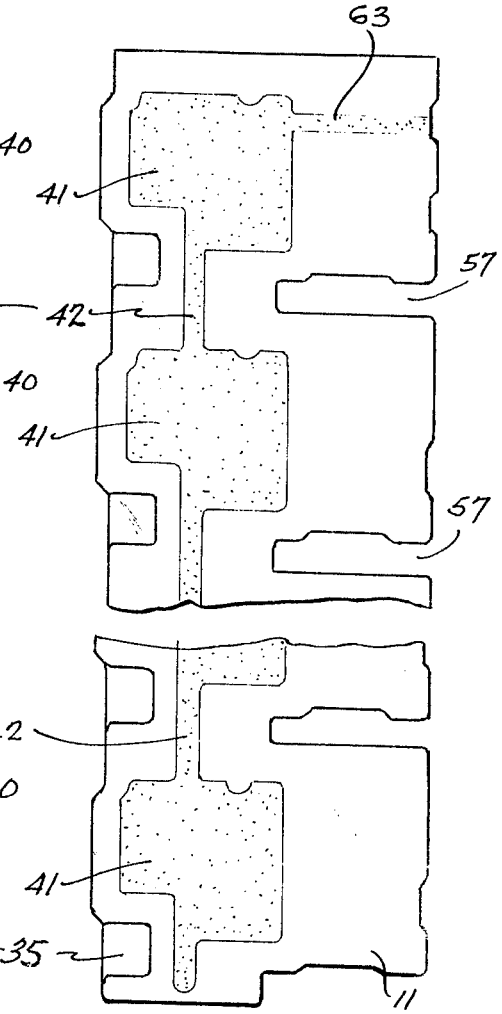
FIG. 20 is the member of FIG. 19 seen from its other side.
Figure 21:
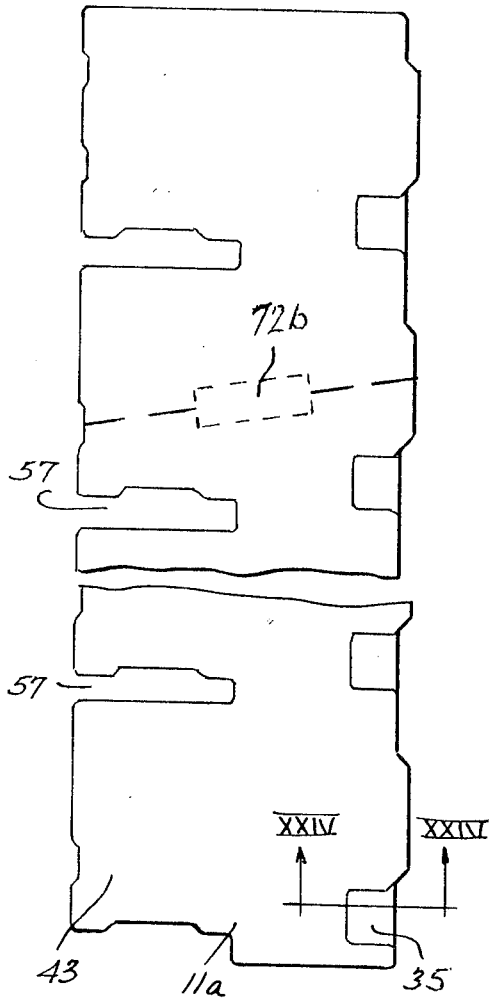
FIG. 21 is a view similar to FIG. 19 of a vertical member modified for use on the left hand, outer side of the block.
Figure 22:
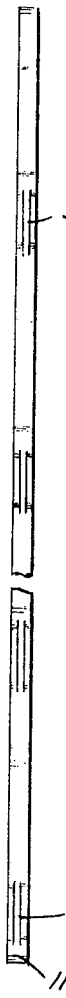
FIG. 22 is an edge view of this member as seen from the right hand side of FIG. 21.
Figure 23:
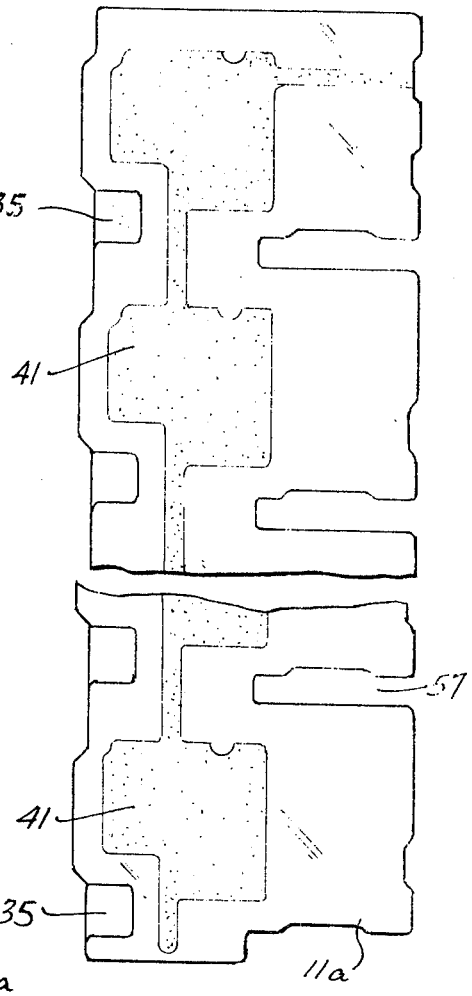
FIG. 23 is a rear view of the member of FIG. 21.

The trigger electrodes 40, 41 are energised through trigger terminals T1 to T7 which extend through the upper edge of the transparent back plate 13 from the exterior (rear surface) shown in FIG. 17 to the inner surface shown in FIG. 15. On this inner surface, the back plate 13 is provided with deposited electrically conducting strips including connecting strips 60 and 62 which serve to connect each respective trigger terminal T1 etc. to the pairs of trigger electrodes 40, 41 associated with a column of display units. Each of the longer strips 60 connects to a strip 61 (FIG. 19) and each of the shorter strips 62 connects to a strip 63 (FIG. 20). These connections between strips 62 and 63 and between strips 60 and 61 are shown by cut-aways at the top right hand corner of FIG. 14.

In this manner each of the terminals T1 to T7 is respectively and uniquely connected to a column of pairs of trigger electrodes 40, 41. It should be appreciated that, in this interconnection, the electrodes of a pair are not the electrodes located back-to-back on the same vertical member 11; rather they are the pair of electrodes that face each other across each individual display unit of the column. They are hence physically located on adjacent vertical members. The trigger electrodes that are mounted back-to-back on a given vertical member are maintained electrically separate from each other, so that each column of units can be separately triggered.

Figure 18:
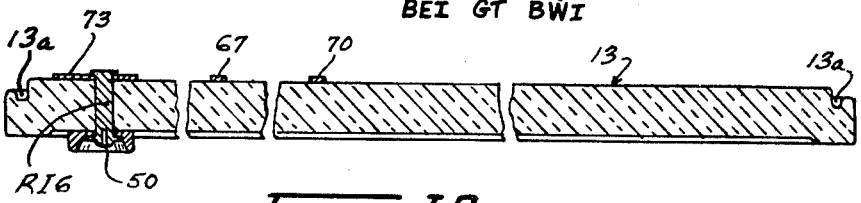
FIG. 18 is a section on the line XVIII—XVIII in FIG. 15 on an enlarged scale.

The electrodes 53 on the top surface of each horizontal member 12 are connected through a strip 64 (FIG. 28) which contacts a small strip 65 (FIG. 15) that projects downwardly from each of a series of "Row Inhibit" terminals RI1 to RI9 disposed on the inner face of the left hand edge of the back plate 13. Terminals T1 to T7 and RI1 to RI9 are formed with jack-receiving sockets 50 on the outer face of the back plate 13, as shown in FIGS. 17 and 18.

The other electrodes 51 on the horizontal members 12 are connected through a strip 66 on each such member to a common vertical strip 67 extending down the inside face of the back plate 13 and terminating in an external "Block Write Inhibit" terminal BWI.

These electrodes 51 and 53 on the upper surface of the horizontal members 12 act as Write Inhibit electrodes, since, when energised, they each attract an adjacent vane that is in its horizontal or ERASE position sufficiently to prevent such vane being moved to its WRITE position should the trigger electrodes be energised. One series, namely the electrodes 53, are connected row-wise to each other and to respective "Row Inhibit" terminals RI1 to RI9 as already explained. The other series, namely the electrodes 51, are not only connected row-wise by the interconnecting strips 52 but are also connected column-wise by the strips 66 and 67. These electrodes 51 are thus connected together block-wise, for which reason the external terminal BWI is referred to as the Block Write Inhibit terminal.

On the underside of each horizontal member 12 (FIG. 30) the individual shielding surfaces 55 are connected together by the strips 68, a common strip 69 serving to connect these surfaces to a vertical strip 70 on the inside face of the back plate 13. Strip 70 extends to ground terminal GT and has branches 70*a* and 70*b* extending to the right hand edge of the plate 13 where they connect respectively to portions 44*a* and 46*a* of grounding strips 44, 46 on the right hand vertical member 11*b* (FIGS. 14 and 27). The strips 44, 46 also have portions 44*b* and 46*b* that are engaged by turned over end portions 32*a* of each of the members 32, thus grounding these members and in turn the vane assemblies that they support.

Finally, the back plate 13 carries on its inner face a conducting strip 71 (FIG. 15) extending from a Block Erase Inhibit terminal BEI to the edge of the plate and hence to a strip 45 on the member 11*b* (FIGS. 14 and 27).

As an alternative to the illustrated construction described above, a high value resistor (a few kilohms) can be used instead of the conducting traces 44*a* and 46*a* to prevent undue electrical stress from occurring across the epoxy joint during arching, i.e. the epoxy joint that is made between the trace portions 44*a* and 46*a* and 70*a* and 70*b*, respectively. The resistance of the epoxy may be higher than the printed traces, resulting in a large voltage drop (with a resultant large energy load) across the joint during arc conditions. Limit resistors (replacing traces 44*a* and 46*a*) can eliminate such stress at the epoxy joints.

THE FRONT PLATE AND ELECTRODE INTERCONNECTION

On its inner face (FIG. 32) the front plate 14 is formed with thin transparent deposits of electrically conducting material forming Erase Inhibit electrodes, i.e. electrodes that act to hold a vane in its upright or WRITE position against the action of the triggering electrodes.

Figure 32:
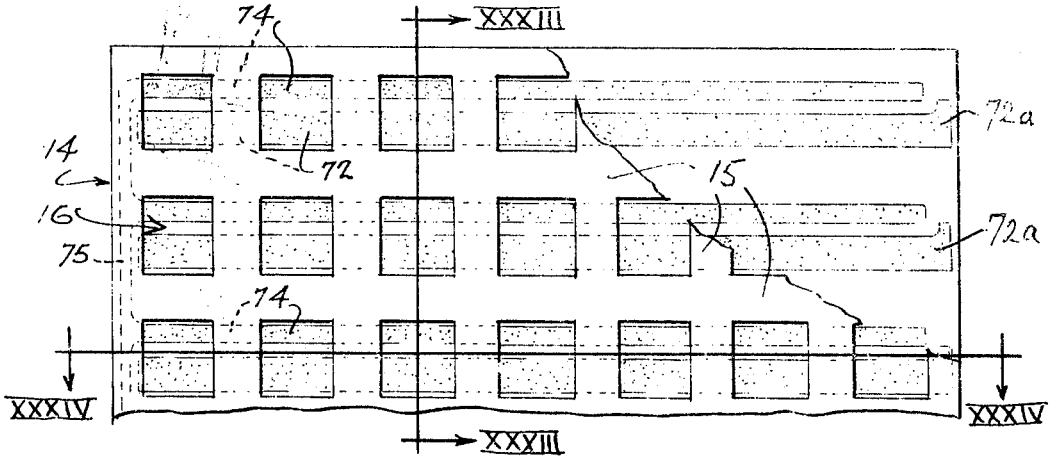
FIG. 32 is a rear view, partly cut away, of the front plate, i.e. as seen from within the block of FIG. 14.

These Erase Inhibit electrodes are in two series. Firstly, along each row there is a lower, wider strip 72 which acts as a Row Erase Inhibit strip and is connected at its right hand end 72*a* as seen in FIG. 32 (left hand in FIG. 14) to a respective one of short strips 73 that extend from respective Row Inhibit terminals RI1 to RI9 via high value resistors 72*b* (FIG. 21) that extend across the outer surface of the left hand vertical member 11*a*. The location of one of these resistors has been shown in FIG. 21 to aid understanding, although in practice these resistors will be added after the honeycomb structure has been made. Alternatively, the connections between each end 72*a* and respective strips 73 of the RI terminals can be made by conducting deposits on the outer surface of the member 11*a*, although resistors 72*b* are preferred for the following reason.

The row inhibit electrodes on the horizontal members have a capacitance C1 with respect to the grounded vanes. Also, the row inhibit electrodes on the frontplate have a capacitance C2 with respect to the grounded vanes. The conducting traces on the frontplate and the horizontal member have resistances *r*2 and *r*1 respectively. Consider all the capacitances charged during a switching cycle. If an arc occurs between a vane and a row inhibit electrode on a horizontal member, both the capacitors C1 and C2 discharge. If no resistor 72*b* is used on the side of the vertical member, the high current resulting from the discharge of C2 could destroy the frontplate row inhibit electrodes. The insertion of resistor 72*b* prevents this from happening. When C2 discharges with resistor 72*b* in place, all the voltage drop occurs across resistor 72*b* and not *r*2. Resistor 72*b* is then a means to protect the thin film frontplate electrodes. Resistor 72*b* must be made much larger (i.e. 100 times) than resistance *r*1.

Each Erase Inhibit strip 72 extends row-wise and is electrically common with the corresponding row-wise strip of Write Inhibit electrodes 53. For this reason, the terminals RI1 to RI9, which provide external connection for both these series of electrodes, are referred to simply as Row Inhibit electrodes, without reference to "write" or "erase", since they serve both functions.

The second series of electrodes on the front plate 14 is an upper series of row-wise narrower strips 74 that are interconnected down one edge by a strip 75, thus interconnecting all such electrodes block-wise. The strips 74 are narrower than the strips 72 because they are located further from the axes of rotation of the vane assemblies and thus need to exert a lesser force on the vane to achieve the same turning moment. The strip 75 is connected to the left hand end of the strip 45 shown in FIG. 27, the right hand end of which, as already indicated, is connected to the strip 71 (FIG. 15) and hence to the Block Erase Inhibit terminal BEI.

STOPS FOR VANE ASSEMBLIES

Figure 6:
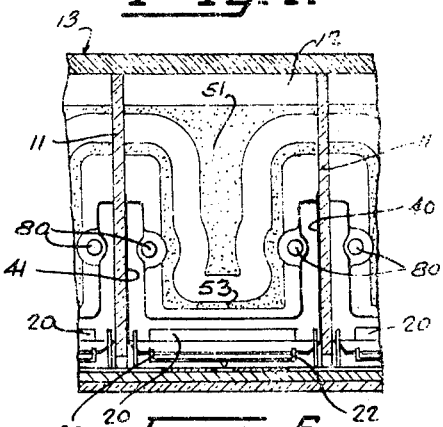
FIG. 6 is similar to FIG. 5 but with the vane assembly in its raised position, i.e. on VI—VI in FIG. 4.

When a vane assembly 20 is in its lowered or ERASE position (FIG. 11) a pair of nibs 22*a* formed on the respective side edges 22 of the vane 21 bear against a corresponding pair of stops 80. FIG. 6 shows the location of the stops 80 in a display unit in plan view, and FIGS. 28 to 31 show how these parts extend through the horizontal members 12 and engage the grounded surfaces 55. The stops 80 are thus grounded, as are the vanes. It has nevertheless been found that it is advantageous to apply a thin layer of an insulating material such as Teflon (Trade Mark) to the upper surfaces of the stops 80, which are contacted by the nibs 22*a*, tending to reduce any tendency for these parts to cling together.

To control accurately the position of a vane in its erect or WRITE position, each vane is formed with a nib 21*a* at the centre of its upper edge, which nib 21*a* engages a portion of the rear surface of a mounting member 32, as shown in FIG. 12, at a location just below a hole 32*b* formed centrally of such member. Again to minimise sticking, this rear surface of the member 32 or at least the part thereof touched by the vane assembly can advantageously be coated with an anti-stick material. As mentioned above, Teflon works well as this material. It is believed that, both in this location and on the stops 80, it is more the anti-stick properties of the Teflon that is responsible for the elimination of sticking than the fact that the material is an insulator. When uncoated metal was tried, sticking occurred and it is felt that the phenomenon responsible was similar to cold welding.

AN ARRAY OF BLOCKS AND CONTROL THEREOF

Figure 35:
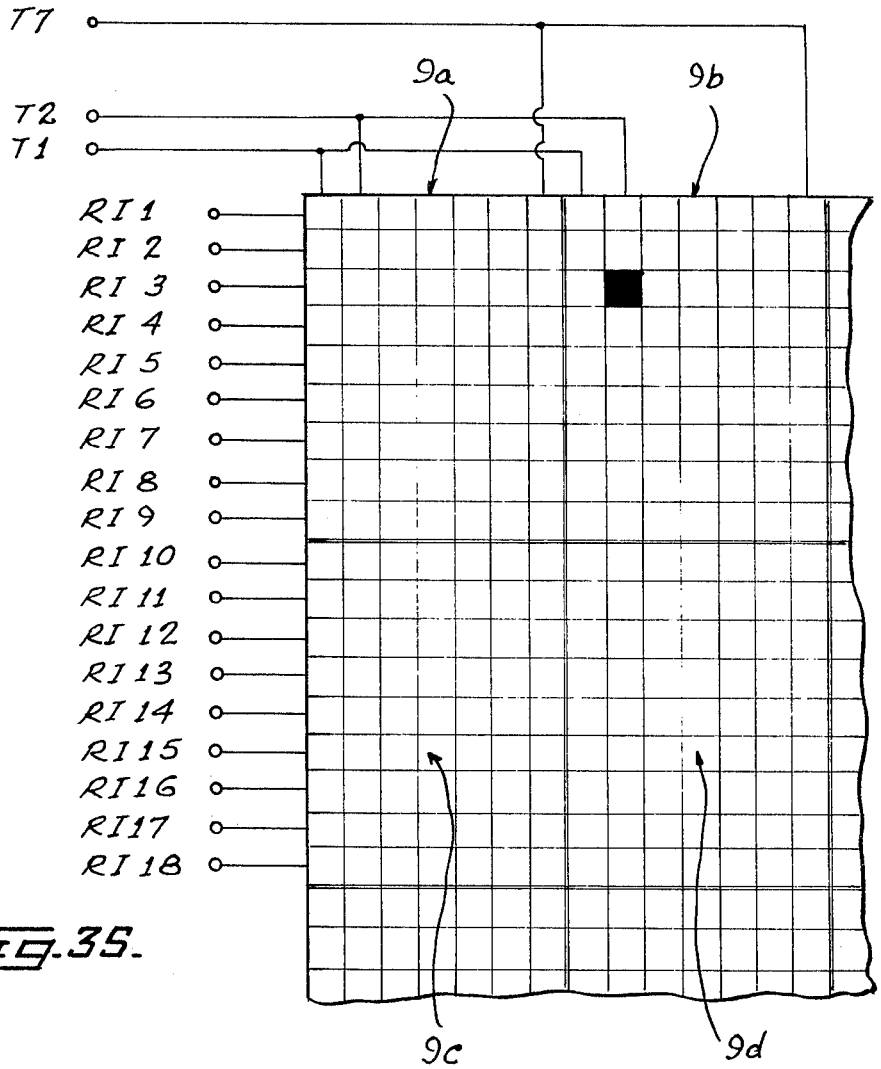
FIG. 35 is a diagram illustrating part of an array of a plurality of blocks each of the type shown in FIG. 14.
Figure 36:
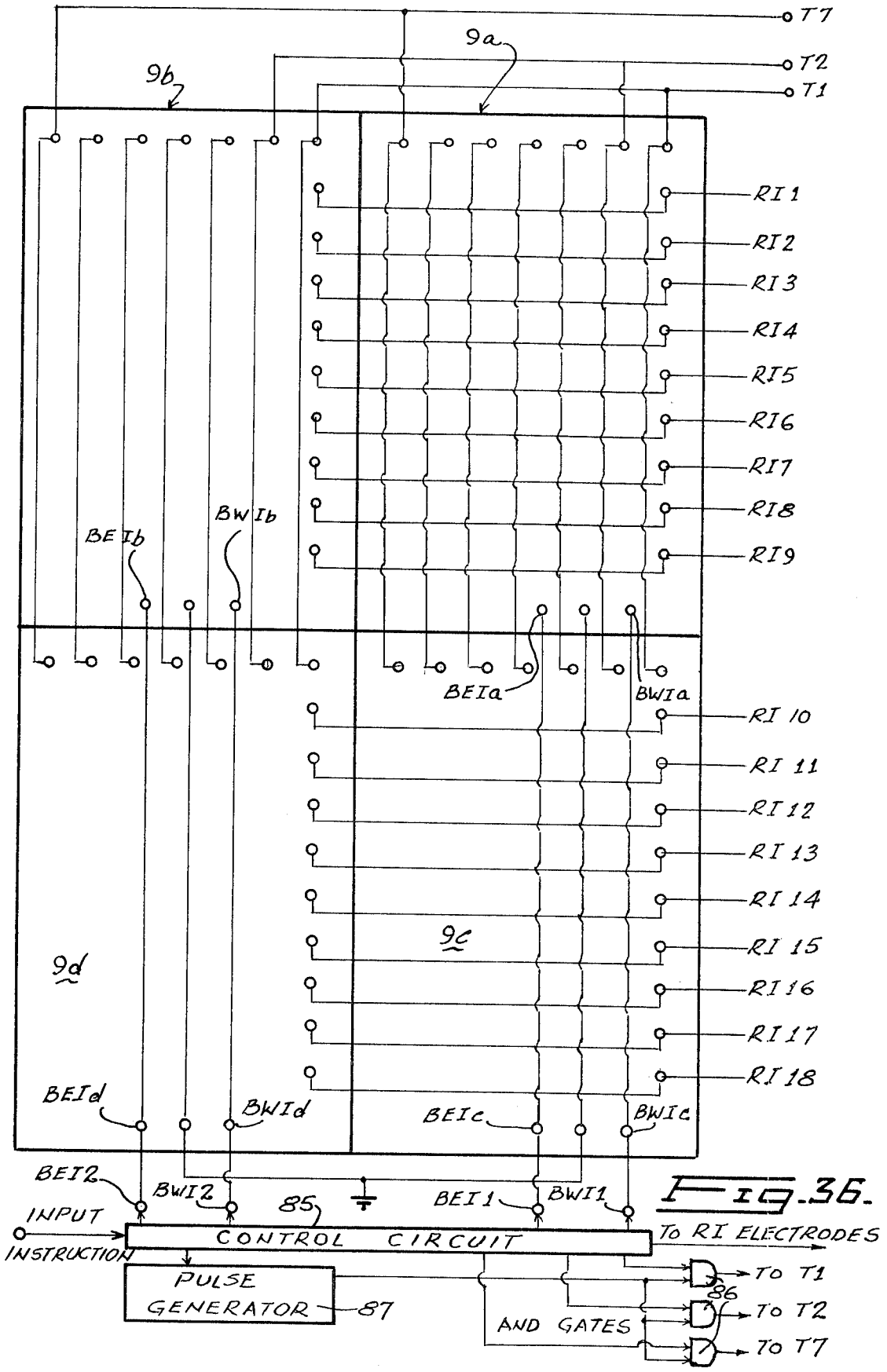
FIG. 36 is a view from the rear of FIG. 35 illustrating operating connections.

Unless the apparatus is to display only a single character, a plurality of blocks of the type already described, will be assembled into an array of rows and columns of blocks. A corner of such an array with blocks 9*a*, 9*b*, 9*c* and 9*d* is illustrated in FIG. 35, the connections at the rear being shown in FIG. 36. Specifically, the Row Inhibit terminals RI1 to RI9 are connected together row-wise in the array, i.e. as between blocks 9*a* and 9*b*, including any subsequent blocks of the first row of blocks. The same row-wise interconnection of Row Inhibit terminals RI10 to RI18 applies to the second row of blocks 9*c*, 9*d* etc.

The trigger terminals T1, T2 etc. are likewise interconnected both row-wise and column-wise between blocks, i.e. terminal T1, for example, is common to all blocks.

The Block Write Inhibit and Block Erase Inhibit terminals of blocks 9*a* and 9*c*, i.e. terminals BWIa, BWIc and BEIa and BEIc are respectively interconnected, together with those of any further blocks (not shown) in the first column of blocks. These connections are brought out as terminals BWI1 and BEI1 respectively. Likewise, terminals BWIb and BWId are brought out together as terminal BWI2, and terminals BEIb and BEId are brought out together as terminals BEI2. Further columns of blocks will be similarly interconnected to higher numbered BEI and BWI terminals.

Assume that all vanes are initially in their ERASE position and it is desired to write the vane shown in FIG. 35, namely the vane in the third row of the second column of the block 9*b* which is in the first row of the second column of the array.

To do this, all the Block Write Inhibit terminals other than that in which the selected vane is connected will be energised. In the present example, terminal BWI1 will be energised; terminal BWI2 will not. Also, all the Row Inhibit terminals will be energised, except the selected row, i.e. RI1, RI2 and RI4 to RI18 will be energised, while terminal RI3 will not. Trigger terminal T2 will then be pulsed to write the desired vane, all the other vanes being prevented from movement by one or other of their Write Inhibit electrodes. A corresponding routine using the Block Erase Inhibit terminals can be employed to erase a selected vane.

While the foregoing example relates only to a single selected vane, it will be apparent that a combination of different vanes in a single column of units can be written (or erased) simultaneously. The columns of units will be written (or erased) in sequence to avoid ambiguity. This process takes only a few seconds for a large number of columns, since the trigger electrode pulsing is short, and is accomplished by a control circuit 85 which, on the basis of appropriate input instructions, initially sets the various inhibit electrodes (RI, BEI and BWI), then energises a selected one of a series of AND gates 86, of which there is one for each trigger terminal T1 to T7, and finally energises a pulse generator 87 causing the selected trigger terminal, e.g. T2, to receive a pulse of controlled length for triggering the desired unit.

The above description for writing vanes assumes that all vanes were initially erased. If some vanes are already written, and one wants to write some additional vanes, it is necessary to energize the BEI terminal in all the blocks during the write cycle. This prevents any previously written vanes from erasing. Similarly, if some of the vanes are written and other erased, and one wishes to erase some additional vanes, the BWI terminal is activated in all blocks during the erase cycle. This prevents any previously erased vanes from writing. The use of the block inhibits in this mode also provides an additional functional use. Consider the case where some of the vanes are written and one plans to write additional vanes without erasing any of the already written vanes. As outlined, the BEI terminals would be activated to inhibit unwanted erasures. In addition, as the selected vanes move from their erased position to the written position, they will be assisted by the attracting force of the BEI electrodes. Once the vanes are past the 45° line in their travel and the trigger electrodes have been deenergised, the vanes will move, not only under the force of gravity, but also under electrostatic attraction to the BEI electrodes. Once a vane hits the front mount, its BEI electrode also keeps the vane from bouncing, contributing to a positive movement action. The block inhibit electrodes thus act as attracting electrodes as well as inhibiting electrodes. They attract the vanes and inhibit them from moving backwards, once they have arrived. The BWI electrodes work similarly in attracting vanes that are being erased and in preventing bouncing once the vanes hit the stops on the horizontal members.

The input instruction to the control circuit 85 can take the form of a stored program, e.g. punched tape, magnetic tape, computor memory, or may be a typewriter keyboard including a device for storing the fixed series of instructions required by the control circuit for writing each individual character. It is noteworthy that the bistable nature of the vanes enables the control circuit and the other input mechanisms no longer to be required (and hence usable for controlling other displays) once the display has been written and until some change is required in it. In other words, no constantly applied memory device is required, other than that which is inherent in the bistable nature of the vanes. The de-energised nature of the system between writing operations also represents a substantial saving in power and prolongation of the life of the equipment.

Not only are the various control electrodes: T1 etc.; RI1 etc.; BWI1 etc. and BEI1 etc., unenergised once the display has been written, but provision can conveniently be made in the control circuit for actually grounding all these electrodes at this time, thus shielding the vanes from the risk of static build up which in some prior displays of the present type has proved a serious problem resulting in malfunctions.

In practical terms, the present modular construction provides a flexibility that enables differently shaped arrays to be built up, using varying numbers of blocks in the rows and columns of the array.

We claim:

1. A display unit comprising
(a) a vane assembly comprising a thin metallic vane and a mount therefor;
(b) means supporting said mount for pivotally supporting the vane assembly about a horizontal axis between a write position in which the vane is substantially vertical and an erase position in which the vane is substantially horizontal;
(c) stops defining said positions;
(d) the vane assembly having a centre of gravity located on one side of said axis in the write position to retain the vane assembly in such write position by gravity and located on the other side of said axis in the erase position to retain the vane assembly in such erase position by gravity, said centre of gravity being located to move between said sides of the axis at a mid position of the vane assembly between said write and erase positions;
(e) a single, electrically common, trigger electrode means located adjacent said vane to exert an attracting electrostatic force thereon to urge the vane assembly towards such mid position from the write position and from the erase position; and
(f) means for applying to said trigger electrode means a short pulse of a voltage relative to that of the vane assembly, said pulse being of such length as to initiate movement of the vane assembly towards said mid position from either the write or erase position and allow said movement to continue beyond the mid position under the momentum of the vane assembly and gravity.

2. A display unit according to claim 1, including write inhibit electrode means located adjacent the vane in the erase position for retaining the vane assembly in the latter position against the action of the trigger electrode means.

3. A display unit according to claim 1, including erase inhibit electrode means located adjacent the vane in the write position for retaining the vane assembly in the latter position against the action of the trigger electrode means.

4. A display unit according to claim 1, wherein said trigger electrode means comprise a pair of electrically common, plate-like electrodes each located in a vertical plane extending transverse to the axis of the vane assembly and each positioned adjacent a respective lateral edge of the vane and in an overlapping relationship therewith.

5. A display unit according to claim 4, including (i) a pair of mutually electrically separate write inhibit electrodes located beneath the vane in the erase position each for retaining the vane assembly in the latter position against the action of the trigger electrodes; and (ii) a pair of mutually electrically separate erase inhibit electrodes located adjacent the vane in the write position each for retaining the vane assembly in the latter position against the action of the trigger electrodes.

6. A display unit according to claim 5, wherein said erase inhibit electrodes are transparent and are formed on a transparent vertical surface located forward of the vane in its write position.

7. A display unit according to claim 1, wherein said stops lie in the path of travel of said vane to define said positions, each stop comprising a metallic member electrically connected to said vane assembly and a layer of anti-stick insulating material on said member located between said member and the vane.

8. A block of a plurality of units each according to claim 1, said units being arranged in horizontal rows and vertical columns, (i) each unit having first and second, mutually electrically separate write inhibit electrodes located adjacent the vane in the erase position for retaining the vane assembly in the latter position against the action of the trigger electrode means; and (ii) each unit having first and second, mutually electrically separate erase inhibit electrodes located adjacent the vane in the write position for retaining the vane assembly in the latter position against the action of the trigger electrode means; and including (iii) respective trigger means electrically interconnecting the trigger electrode means of the units of each vertical column;

(iv) respective row inhibit means electrically interconnecting the first write inhibit electrodes and the first erase inhibit electrodes of the units of each horizontal row;

(v) block write inhibit means electrically interconnecting the second write inhibit electrodes of all the units of the block; and (vi) block erase inhibit means electrically interconnecting the second erase inhibit electrodes of all the units of the block.

9. An array of a plurality of blocks each according to claim 8, said blocks being arranged in horizontal rows and vertical columns, including (vii) means electrically interconnecting the respective trigger means of all the blocks of the array;

(viii) means electrically interconnecting the respective row inhibit means of the blocks of each horizontal row of blocks;

(ix) means electrically interconnecting the block write inhibit means of the blocks of each vertical column of blocks; and (x) means electrically interconnecting the block erase inhibit means of the blocks of each vertical column of blocks.

10. A module forming a plurality of display units arranged in horizontal rows and vertical columns, said module comprising (a) a plurality of spaced apart, parallel, flat, elongated horizontal members each formed along its length with a series of spaced apart, parallel slots extending inwardly from a first elongated edge thereof, (b) a plurality of spaced apart, parallel, flat, elongated vertical members each formed along its length with a series of spaced apart, parallel slots extending inwardly from a first elongated edge thereof, (c) said horizontal and vertical members being secured together with their slots interleaved to form a rigid honeycomb structure providing rows and columns of rectangular enclosures between the horizontal and vertical members, each such enclosure forming a said display unit, (d) rectangular front and back plates overlying second elongated edges of the vertical and horizontal members opposite said first elongated edges whereby to enclose said enclosures, (e) a vane assembly mounted in each enclosure, said vane assembly comprising a thin metallic vane and a mount therefor, (f) means supporting each said mount for pivotally supporting its vane assembly about a horizontal axis between a write position in which the vane is substantially vertical and an erase position in which the vane is substantially horizontal, (g) stops defining said positions, (h) each vane assembly having a centre of gravity located on one side of said axis in the write position to retain the vane assembly in such write position by gravity, and located on the other side of said axis in the erase position to retain the vane assembly in such erase position by gravity, said centre of gravity being located to move between said sides of the axis at a mid position of the vane assembly between said write and erase positions, (i) a pair of electrically common trigger electrodes formed in each enclosure on a pair of facing surfaces of an adjacent pair of said vertical members, said trigger electrodes being located adjacent a said vane to exert an attracting electrostatic force thereon to urge the vane assembly towards its mid position from the write position and from the erase position; and (j) means for applying to each said pair of trigger electrodes a short pulse of a voltage relative to that of the vane assembly, said pulse being of such length as to initiate movement of the vane assembly towards said mid position from either the write or erase position and allow said movement to continue beyond the mid position under the momentum of the vane assembly and gravity.

11. A module according to claim 10, including electrodes formed on upper surfaces of each horizontal member to be located adjacent each vane in its erase position for retaining it in the latter position against the action of the trigger electrodes.

12. A module according to claim 10, including electrodes formed on the front plate to be located adjacent each vane in its write position for retaining it in the latter position against the action of the trigger electrodes.

* * * * *